United States Patent [19]

Sano

[11] Patent Number: 4,563,966

[45] Date of Patent: Jan. 14, 1986

[54] SWITCHING MECHANISM FOR ELECTRONICALLY CONTROLLED SEWING MACHINE

[75] Inventor: Yasuro Sano, Tokyo, Japan

[73] Assignee: Janome Sewing Machine Co., Ltd., Tokyo, Japan

[21] Appl. No.: 568,805

[22] Filed: Jan. 6, 1984

[30] Foreign Application Priority Data

Jan. 19, 1983 [JP] Japan ..... 58-5860

[51] Int. Cl.[4] ..... D05B 3/02

[52] U.S. Cl. ..... 112/455

[58] Field of Search ..... 112/158 E, 158 B, 314, 112/315, 316, 455, 453

[56] References Cited

U.S. PATENT DOCUMENTS

| | | | |
|---|---|---|---|
| 4,167,912 | 9/1979 | Sedlatschek | 112/314 X |
| 4,183,314 | 1/1980 | Sato | 112/316 |
| 4,299,180 | 11/1981 | Kume et al. | 112/158 E |
| 4,342,271 | 8/1982 | Socha | 112/315 X |

*Primary Examiner*—Peter Nerbun

*Attorney, Agent, or Firm*—Michael J. Striker

[57] ABSTRACT

An electronic control for a sewing machine, which electronically stores needle amplitude amounts and feed amounts as pattern signals, including a control motor having an output shaft with a center, an output arm affixed to the output shaft of the control motor and a guide pin connected with the output arm and a guide cam disposed at a predetermined distance to the control motor and having first and second grooves being arc-shaped and having different radii from the center of the output shaft of the control motor so as to provide both normal and reduced amounts of feed.

4 Claims, 15 Drawing Figures

SWITCHING MECHANISM FOR ELECTRONICALLY CONTROLLED SEWING MACHINE

BACKGROUND OF THE INVENTION

The present invention relates to a switching mechanism for a sewing machine with an electronic control which electronically stores, as pattern signals, the amount of needle amplitudes and fabric feeds, drives a control motor per rotation of the sewing machine in response to the pattern signals, outputs the rotation of the control motor via a link mechanism and produces stitching patterns, and more particularly relates to a switching mechanism for the control mount of the electronic control sewing machine.

With respect to the fabric feed amount in the control amount for the formation of stitching patterns by an electronic sewing machine it is practically sufficient in almost all of the patterns to divide the 8 mm between the forward 5 mm and the backward 3 mm into 16 steps and prepare the control for 0.5 mm increment. However in the buttonhole stitching fine feed amounts around 0.25 mm are required, and for this reason it is necessary to divide the 8 mm into 32 steps.

In the electronic control sewing machine which outputs the rotation of the control motor via a turning link, the range of the rotation angle of the turning link is limited to be less than 90° in view of the mechanism. Therefore, for obtaining the fabric feed amounts around 0.25 mm, it is necessary to make the stepping angles of the control motor rotating the turning link less than around 2.8° which is obtained by dividing the 90° into 32 steps.

With respect to the fabirc feed amount in the control amount, for example, as shown in FIG. 1, if the maximum amount W of the needle amplitude is divided into 16 steps, the zigzag pattern as shown may be formed. However, in such patterns where the minimum amount of the needle amplitude is used in one step (in regard to the needle amplitude amount such as (1)-(2)-(3) and (18)-(19)-(20)) in the needle droppings, needle amplitudes smaller than this minimum needle amplitude could not obtained, and the pattern could not be reduced proportionally in the amplitude direction.

In this case, if the maximum amount W of the needle amplitude is determined to be divided into 32 steps, it is possible to proportionally reduce by ½, the stitching pattern as shown in FIG. 1 in the amplitude direction, and thus the stitching application will be preferably broadened. Also in this case, the stepping angle of the control motor should be less than about 2.8° for the fabric feed.

For the above mentioned reason, the electronic sewing machine which employs the control motor and outputs the rotation of the motor via the turning link, has conventionally and structurally used a pulse motor of the hybrid type which produces the comparatively small stepping angle. However, this type of pulse motor has the following problems:

In comparison with the pulse motors of other types, inertia of the motor is larger; it takes a long time to determine the positioning; the rotation speed of the sewing machine is restricted; and vibrations, noises and other inconveniences are generated at the time of the slight stepping.

High precision is required to obtain a small stepping angle, so that the motor would be expensive.

Therefore, in the electronic control sewing machine using the turning link as mentioned above, pulse motors of the induction type belonging to PM (permanent magnet) have been reconsidered for the control motor. In comparison with the hybrid type, the inductor type can structurally lessen the inertia of the rotor, and can also be produced at an economical cost. However, it is difficult to apply the inductor type to a electronic control sewing machine, since small stepping angles cannot be obtained as can in the hybrid type.

SUMMARY OF THE INVENTION

In view of these circumstances, the present invention provide a switching mechanism for the control amount which uses a motor having a comparatively large stepping angle as the control motor in the electronic control sewing machine and outputs rotation of the control motor as the control amount via the turning link.

BRIEF DESCRIPTION OF THE DRAWINGS

FIG. 12 is an example of a stitching pattern produced by the normal feed and amplitude control;

FIG. 13 shows a reduction in the pattern of FIG. 12;

FIG. 14 shows a reduction in the feed of the stitching pattern of FIG. 12; and FIG. 15 shows a reduction in the aplitude and the feed of the stitching pattern of FIG. 12.

DETAILED DESCRIPTION OF THE PREFERRED EMBODIMENT

Figure 2:
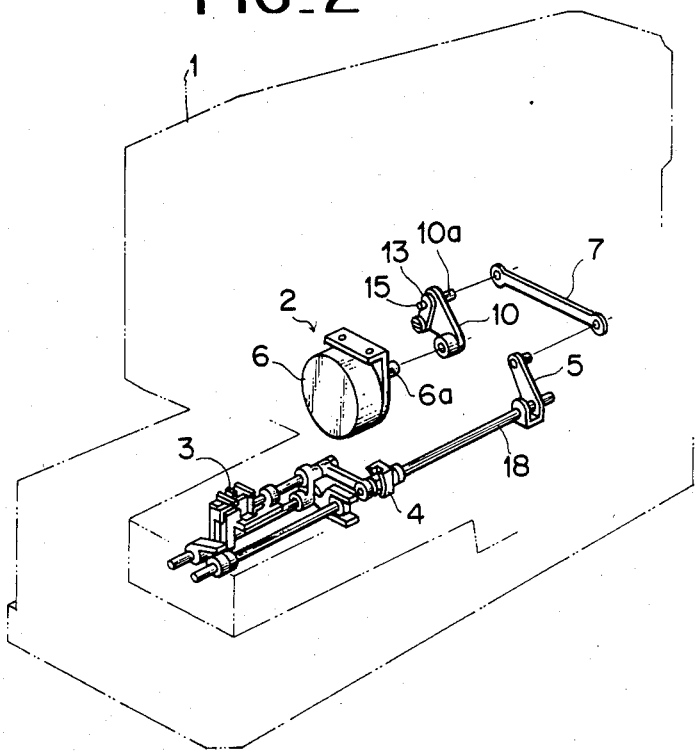
FIG. 2 is a perspective view showing the fabric feed control of the present invention of the sewing machine.
Figure 3:
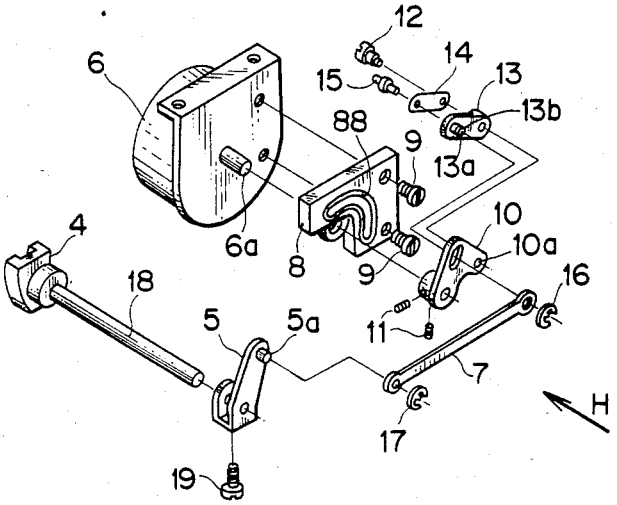
FIG. 3 is a perspective view showing the main parts of a switching mechanism and a fabric feed controller of the present invention.

The invention will be explained with reference to embodiments shown in the attached drawings. In FIG. 2, the numeral 1 is a machine body, and 2 is a fabric feed controller where, as shown, are provided a feed dog 3, a feed regulator 4, a feed control arm 5, a feed control motor 6 (henceforth referred to as "motor") and a feed rod 7. In FIG. 3, the motor 6 is secured, by screws with a guide cam 8, and a rotor shaft **6*a* is secured to a feeding output arm 10 by stopper screws 11**.

A stepped screw 12 is screwed into a screw portion **10*a* of the output arm 10 and thereon mounts a feeding link 13 and a guide pin spring 14. A hole 13*a* in the link 13 is inserted with one end of a guide pin 15 while the other end of the guide pin 15 is fitted in a groove 88 of the guide cam 8 by the action of the guide pin spring 14**.

The feed rod 7 is thrust-stopped by an E ring 16, at its one end, on a shaft portion 13*b* of the feed link 13, and is thrust-stopped by another E ring 17, at its other end, on a shaft portion 5*a* of the feed control arm 5. The feed control arm 5 is fixed on a shaft 18 which is mounted, by a screw 19, with the feed regulator 4.

Figure 4:
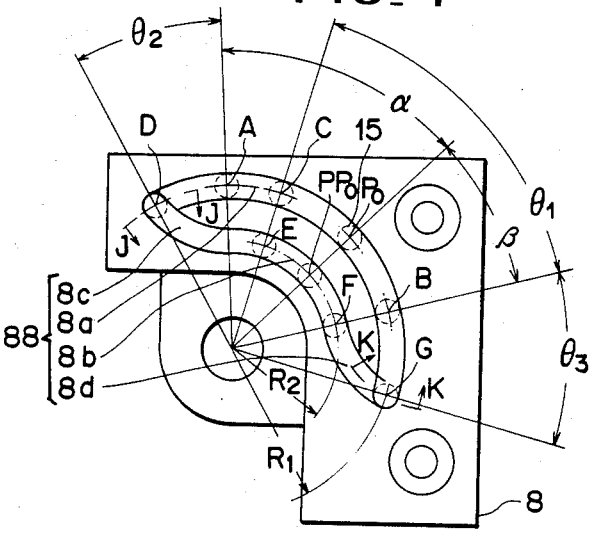
FIG. 4 is a view seen from H in FIG 3.

In FIG. 4, the groove 88 of the guide cam 8 comprises a first groove 8*a* of radius R1 fom the center of the rotor shaft 6*a*, a second grooves 8*b* of radius R2, and groove 8*c* and 8*d* connecting grooves 8*a*, 8*b* to each other. The guide pin 15, fitted in the groove 88 of the guide cam 8, is moved along the groove 88 by rotation of the motor 6 via the feed arm 10 and the feed link 13.

Figure 5:
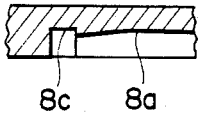
FIG. 5 is a view seen from J—J in FIG. 4.
Figure 6:
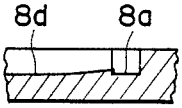
FIG. 6 is a view seen from K—K in FIG. 4.
Figure 7:
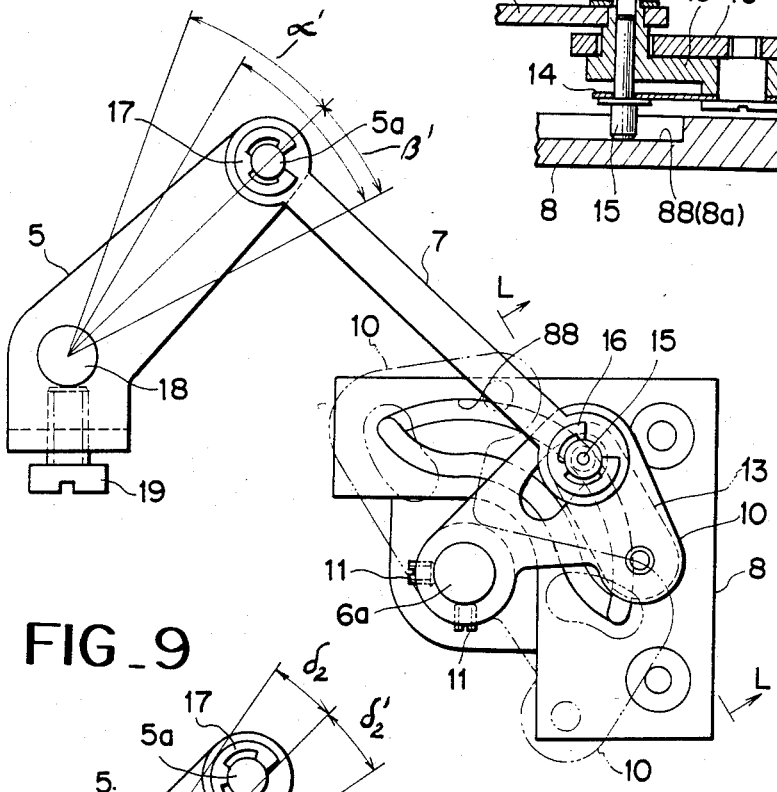
FIG. 7 is a view showing the normal feed control of a switching mechanism of the present invention.
Figure 8:
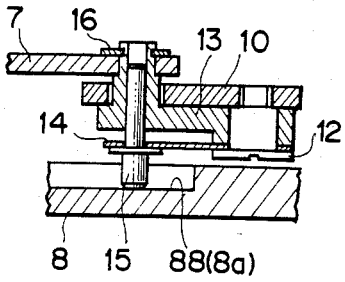
FIG. 8 is a view seen from L—L in FIG. 7.

There is a step formed, as shown in FIG. 5, between grooves 8*a* and 8*c*, and also as shown in FIG. 6, between the grooves 8*d* and 8*a*.

When the guide pin 15 is moved with an angle from the axis of the rotor shaft 6*a*, and when the guide pin 15 is guided in the first groove 8*a* of the radius R1 from the axis of the rotor shaft 6*a* (henceforth referred to as "normal feed") the angle is the rotation angle, since the position of the guide pin 15 is not changed with respect to the feed arm 10. This rotation is also the same when the guide pin 15 is guided in the second groove 8*b* of the radius R2 from the axis of the rotor shaft 6*a* (henceforth referred to as "reduced" feed).

The feed is 0 in the normal feed when the center of the guide pin 15 is at a position PPo. The guide pin 15 is rotated between point A and point B by the guide pin 15 which is rotated from the position PPo forward by an angle $\alpha$ (angle of the rotor shaft 6*a* from the axis), and in point B the guide pin 15 is rotated from a position Po backward by an angle $\beta$ Angles $\theta_1$, $\theta_2$ and $\theta_3$ indicate the control range of the guide pin 15 when operating the super pattern. Points C and B are at the same angle in both forward and backward directions from the position Po.

In the reduced feed, the feed is 0 when the center of the guide pin 15 is positioned at the position PPo, between points E and F by the motor 6.

A further reference will be made to the operation of the embodiment of the present invention. The guide pin 15 is rotated by the motor 6 in accordance with the program stored in the memory of the sewing machine and switched to either the normal feed or to the reduced feed. This switching is made in association with the pattern selection when the button hole stitching is selected from the normal pattern and vice versa. In other cases, the switching is carried out in association with the order of manual operation of the other members.

The switching from the first groove 8*a* to the second groove 8*b* is made via the groove 8*c*, and the switching from the second groove 8*b* to the first groove 8*a* is made via the groove 8*d*.

When switching from the first groove 8*a* to the second groove 8*b*, the motor 6 moves the guide pin 15 by angle $\theta_2$ from point A to point D in a counterclockwise direction and positions the guide pin 15 at one end of the groove 8*c* and then rotates in a clockwise direction to position the guide pin 15 in the second groove 8*b* through the groove 8*c*.

In this switching, due to the difference in step formed between the grooves 8*a* and 8*c* as shown in FIG. 5, when the guide pin 15 is pressed by the spring 14 to the bottom of the groove it is moved to point D and the motor 6 is rotated in a clockwise direction. The guide pin 15 does not return to the groove 8*a* but instead is guided to the groove 8*b*, so that the reduced feed condition is achieved.

When the guide pin 15 is switched from the second groove 8*b* to the first groove 8*a*, the motor 6 rotates in a clockwise direction to move the guide pin 15 to point G which exceeds and positions the guide pin 15 in the groove 8*a*. The motor 6 then rotates in a counterclockwise direction for more than the angle $\theta_3$ to guide the guide pin 15 between point a and point B of the groove 8*a*.

In this switching, due to the difference in step formed in the grooves 8*d* and 8*a* as shown in FIG. 6, when the guide pin 15 is moved to point G and the motor 6 is rotated in a counter-clockwise direction, the guide pin 15 does not return to the groove 8*d* but is instead guided along the groove 8*a* to achieve the normal feed condition.

Figure 9:
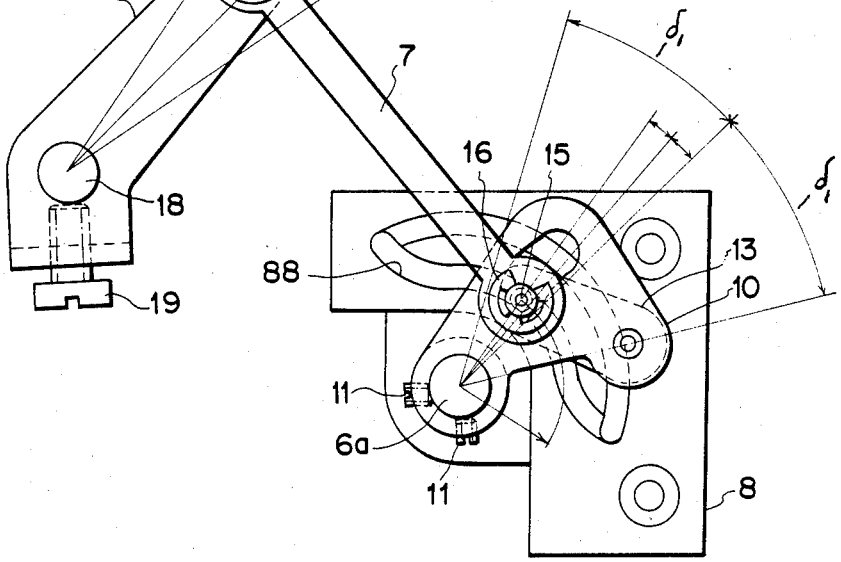
FIG. 9 is a view showing the reduced feed control of a switching mechanism of the present invention.

Assuming both that the rotation angles $\delta 2$ (FIG. 9) and $\delta' 2$ are in the normal feed condition and that the reduced feed condition of the feed control arm 5 is at the same rotation angle of the control motor 6, then the relation of "$\delta' 2 \approx (R2/R1)\delta 2$" is obtained between the rotation angle $\delta 2$ and $\delta' 2$. That is, $$\text{The amount of reduced feed} \approx (R2/R1) \times (\text{normal feed})$$

Figure 10:
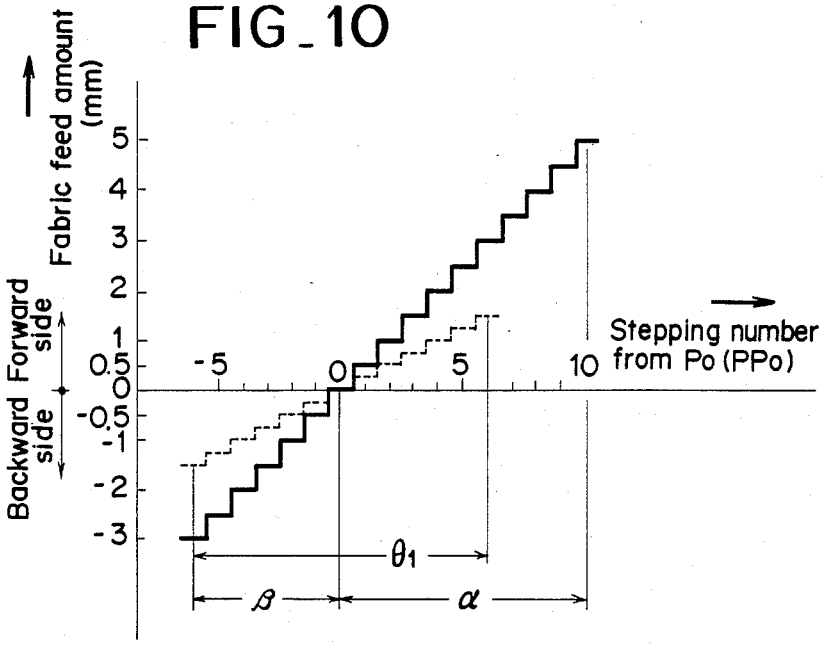
FIG. 10 shows the feed control of the switching mechanism of the present invention.

The present embodiment uses the motor 6 having a stepping angle of 5°. In FIGS. 4 and 10, the distance of 8 mm between the forward 5 mm and the backward 3 mm is divided into 16 steps where $\alpha$ at time of the normal condition is 50° and the forward side is 10 steps, and $\beta$ is 30° and the backward side is 6 steps. The feed amount of each of the steps is changed by 0.5 mm as shown with the solid line in FIG. 10. At the time of reduced feed controlling, in FIG. 4, the forward and backward sides are each 6 steps, and when R2/R1 is 0.5 (different from the conditions shown in FIG. 4 and others), the feed amount of each of the steps is changed per 0.25 mm as shown with the dotted line in FIG. 10.

The control of the amount and the switching of the needle amplitude can be carried out by means of the same cam because the guide cam 8 is used for controlling the amount of the needle amplitude and for switching the needle amplitude.

Figure 11:
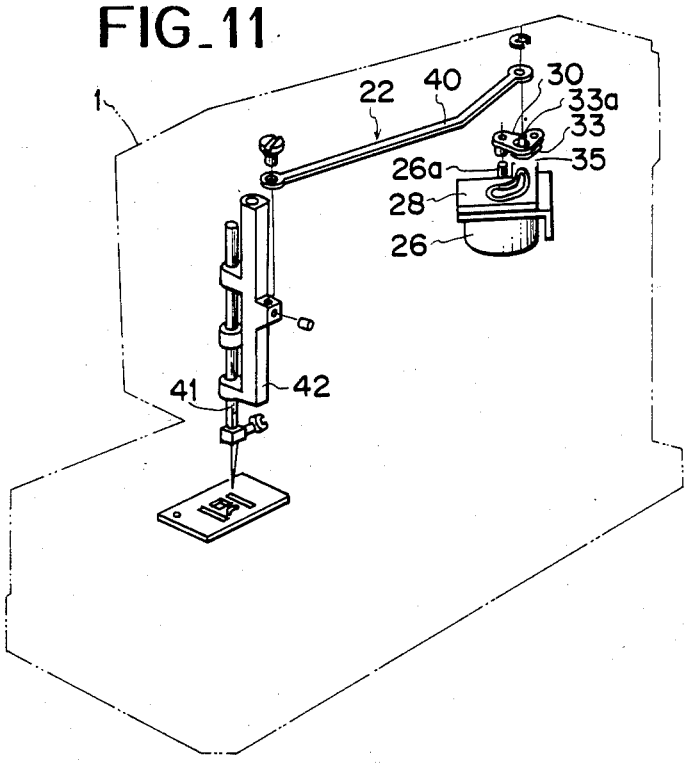
FIG. 11 is a perspective view showing the controller of the needle amplitude of the present invention.

In FIG. 11, the numeral 22 is a needle amplitude controller. A control motor 26 (henceforth referred to as "motor"). A guide cam 28 and an amplitude output arm 30 turnably hold an amplitude link 33 and guide a guide pin 35. The amplitude are 30 is secured on an output shaft 26*a* of the motor 26. The link 33 is connected at its shaft 33*a* to a needle bar holder 42, via an amplitude rod 40. Bar holder 42 guides a needle bar 41.

The guide cam 28 has the same shape as the guide cam 8 shown in FIG. 4 and is placed such that point A of the guide pin 15, in FIG. 4, corresponds to the right basic line of the needle bar 41 and point B corresponds to the left basic line of the needle bar 41. The guide cam 28 is switched to the normal amplitude controlling condition and to the reduced amplitude controlling condition in the same manner as is done in switching the feed.

Figure 1:
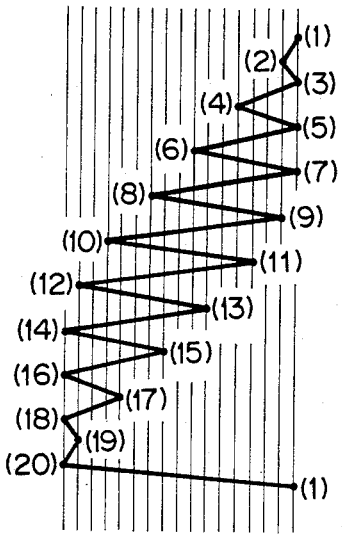
FIG. 1 is an example of stitching lines of the prior art.
Figure 12:
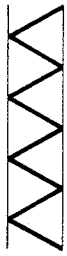
FIGS. 12 to 15 show examples of applied stitchings of the needle amplitude of the present invention.
Figure 13:
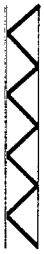
Figure 14:
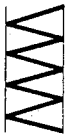
Figure 15:
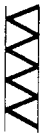

According to the switching mechanism of the present invention, the switching operation is available not only in switching from the normal feed controlling condition to the reduced feed controlling condition in association with the pattern selection, but also in switching with regard to the order of the manual operation of the other members. For example, when the needle amplitude is reduced with respect to the pattern shown in FIG. 12, the pattern shown in FIG. 13 is obtained, and when the feed is reduced, the pattern shown in FIG. 14 is obtained. Furthermore, when the amplitude and the feed are reduced concurrently, the pattern shown in FIG. 15 is obtained. Thus, with the present invention the application of stitchings may be broadened.

I claim:

1. A switching mechanism for a sewing machine having a needle laterally swingable and vertically reciprocated to penetrate a fabric to form stitches therein; a fabric feeding device including a feed regulator variably adjustable to change a fabric feeding amount; a control motor including a rotor shaft having a central axis of rotation and having a predetermined minimum angular step with which said rotor shaft is steppingly and continuously rotated, said rotor shaft being connected to at least one of said needle and said feed regulator, and an electronic memory storing stitch control data for controllingly driving said control motor to control at least one of the needle swinging amplitude and the fabric feeding amount, the switching mechanism comprising link means connected to the rotor shaft of the control motor; follower means secured to said link means and spaced radially from said central axis of said rotor shaft; cam means including a first cam groove and a second cam groove each being arc shaped and spaced radially from said central axis of said rotor shaft and receiving therein said follower means, said first and second cam grooves each extending in a predetermined angular range and each having a different radius, said first cam groove and said second cam groove being connected to each other to form a single continuous cam groove; and transmission means including a transmission rod connecting said follower means to at least one of said needle and said feed regulator, said control motor being driven to switch said follower means between said first cam groove and said second cam groove and vice versa to thereby control a fabric feeding amount and a needle amplitude.

2. The switching mechanism as defined in claim 1, wherein said link means comprises an arm having an end secured to said rotor shaft and a link having an end pivotally connected to said arm, and wherein said follower means includes a pin mounted on said link and having one end engaging one of said first and second cam grooves and another end connected to said transmission rod.

3. The switching mechanism as defined in claim 1; said cam means further comprising third and fourth grooves connecting said first and second grooves to each other.

4. The switching mechanism as defined in claim 2; wherein said link means further comprises a pin spring disposed between said pin and said feeding link for biasing said pin in said first and second grooves.

* * * * *